United States Patent [19]

Killeen

[11] Patent Number: 4,690,248

[45] Date of Patent: Sep. 1, 1987

[54] PORTABLE HOIST

[76] Inventor: Walter H. Killeen, 210 S. Lopez St., New Orleans, La. 70119

[21] Appl. No.: 881,691

[22] Filed: Jul. 3, 1986

Related U.S. Application Data

[63] Continuation of Ser. No. 631,852, Jul. 18, 1984, abandoned.

[51] Int. Cl.[4] ..... E04G 1/08

[52] U.S. Cl. ..... 182/118; 182/27; 182/16; 182/17; 182/209; 182/155; 182/127

[58] Field of Search ..... 182/127, 27, 20, 21, 182/155, 152, 129, 148, 149, 141, 184, 195, 207, 209, 201-204, 225, 12-17, 118; 248/439; 108/132

[56] References Cited

U.S. PATENT DOCUMENTS

| | | | |
|---|---|---|---|
| 1,021,629 | 3/1912 | Reichardt | 182/129 |
| 1,691,976 | 11/1928 | Kramer | 182/209 |
| 1,894,489 | 1/1933 | Hirose | 182/125 |
| 1,934,086 | 11/1933 | Page | 182/118 |
| 2,542,398 | 2/1951 | Crumpton | 182/209 |
| 3,276,542 | 10/1966 | Pommier | 182/16 |

FOREIGN PATENT DOCUMENTS

| | | | |
|---|---|---|---|
| 1194813 | 11/1959 | France | 182/27 |
| 1502163 | 11/1967 | France | 182/27 |
| 1012669 | 12/1965 | United Kingdom | 182/20 |

*Primary Examiner*—Reinaldo P. Machado
*Assistant Examiner*—Alvin Chin-Shue
*Attorney, Agent, or Firm*—George A. Bode

[57] ABSTRACT

A collapsible frame of a general ladder shape having elongated side rails connected by transverse support members. The frame defines an inverted U-shaped frame when in its unfolded operative position. A winch and pulleys attached to the frame are used for lifting or lowering a load. One downwardly extending leg of the frame has telescoping legs and wheels to provide for height adjustment and use as a hand truck for transporting a load. The second leg of the frame may be connected to a ladder bracket and ladder for lifting a load to an elevated location.

6 Claims, 10 Drawing Figures

PORTABLE HOIST

This is a continuation of application Ser. No. 631,852, filed July 18, 1984, abandoned.

BACKGROUND OF THE INVENTION

1. Field of the Invention

The invention relates to a portable hoist, and more particularly relates to a portable hoist adapted to remove a load from a vehicle, transport the load to a site and in combination with a ladder, lift the load to a rooftop and transport the load to an installation position.

2. Description of the Prior Art

In the past, various portable hoists and load carrying devices have been used to transport objects across level surfaces and in combination with a ladder for hoisting objects to elevated locations such as rooftops or the like. An example of a load carrying device would be a gantry supported by wheeled dollies which transports an object across level ground. An example of a hoisting device used in combination with a ladder would be a substantially rectangular framework having rollers thereon which fit along the side rails of a ladder to allow hoisting and rolling of the framework and an attached load up the ladder to the level of a roof top thereby placing the entire load on the ladder members. These and other known hoist devices are useful but none provide a means of unloading an object from a vehicle such as a truck, transporting the object to the ladder and then hoisting the object up to the top of the building and placing it in position on a flat or slightly inclined rooftop without subjecting the ladder to undue stresses.

U.S. Pat. No. 3,093,209, issued to L. Nagy, discloses a combination step ladder/scaffold which teaches the use of a step ladder element, prop element and platform element which pivot with respect to each other to collapse the apparatus. The device further teaches the ladder element having wheels for its own transportation.

U.S. Pat. No. 3,722,621, issued to M. L. Jones discloses a ladder bench having horizontal telescopic bench surface mounted on ladder suporting elements located at each end. The ladder support elements are extendable so that the bench may be raised to a scaffold height. The supports are hingedly attached to the bench element so that the apparatus may be collapsed for storage or transportation.

U.S. Pat. No. 3,494,492, issued to W. E. Thiermann discloses a horizontal beam member supported by two posts capable of being extended, both posts being supported by wheels. A load support and hoist member is disclosed but does not provide for collapsibility of the device nor adaptation to a ladder.

U.S. Pat. No. 2,606,001, issued to C. E. Lepper, discloses a wheeled structure arranged to lift and transport heavy articles by means of a cable and hook provided on a horizontal member.

U.S. Pat. No. 2,573,604, issued to J. C. Richardson, et al., discloses a horizontal wheeled U-shaped frame with a hoisting element mounted on a cross-beam.

U.S. Pat. No. 2,798,574, issued to R. D. Wardell, discloses a scaffold with a hoist structure mounted thereon having a pulley cable and a hoist cage which can be raised and lowered to the level of the scaffold.

U.S. Pat. No. 2,706,057, issued to H. F. Belding, discloses a structure providing a hoist element comprised of a cable, reels and pulley mounted on one of the legs provided.

U.S. Pat. No. 4,183,423, issued to J. P. Lewis, and U.S. Pat. No. 2,405,505, issued to A. J. Kleidon, both disclose a ladder hoist in which the hoisting mechanism is provided integral with the ladder. The Lewis patent discloses a cable on a winch which runs over a pulley on the top section of the ladder and is connected to a carriage having wheels running in channel-like sides of the ladder member.

U.S. Pat. No. 3,666,054, issued to F. L. Ellings, et al., discloses a hand truck mounted on rollers arranged for engagement with the rails of a ladder and a winch for movement of the hand truck up and down the ladder.

U.S. Pat. No. 2,599,169, issued to F. B. Finney, discloses a bracket for supporting the top of a ladder away from a wall, the bracket being attachable and detachable from the ladder without the use of tools. However, this device places high stresses on the ladder members because it does not properly support the rooftop end and, therefore, has limited capacity. It further does not teach hinging of the ladder while supporting the rooftop end to prevent undue stresses in the ladder.

None of the previous art solves the need for an apparatus which can be operated by one man and is capable of removing a load from a vehicle, transporting the load to a ladder, hoisting the load up to a roof top, placing the load on the roof top and transporting the load across the roof top to a desired installation position.

SUMMARY OF THE INVENTION

The present invention satisfies the aforementioned needs by providing a collapsible wheeled lifting apparatus adapted to be supported on the upper end of a ladder or a similar support structure by one of its supporting elements and a second supporting element with a cross member pivotally connected therebetween for supporting a lifting element. The entire apparatus is capable of lifting a heavy object from ground level to a roof of a multi-story building and transporting the object across the roof to a desired location. The collapsible frame is of a general ladder shape having elongated side rails connected by transverse support members. The frame, when in its unfolded operative position, defines an inverted U-shaped load supporting frame. The frame is comprised of three main elements. A horizontal support has pivotally connected at each end downwardly extending legs. Each leg is locked into its downward operative position by snap latches attached to the horizontal support and the downwardly extending legs. Mounted on the lower ends of one leg member are lockable wheels to prevent unwanted movement of the apparatus during lifting or lowering of a load. The second leg may be locked into position on a bracket connected to a ladder or similar support structure, the entire apparatus then serving as a support structure with the ladder type support structure for lifting or lowering an object between ground level and roof level without placing undue stresses on the support structure thereby gaining lifting capacity.

The apparatus may be used as a hand truck to transport an object to a desired position. Lifting and lowering of an object is accomplished through a winch attached to the first leg of the apparatus and pulleys on the horizontal support for guiding a cable, attached to an object, through the center of the horizontal support. When in its folded state the apparatus forms a compact structure which may be stored on the side of a truck when not in use and carried to a roof top by being strapped to the back of the user while climbing a ladder to the roof top. The use of light weight materials for constructing the apparatus makes transportation when in its folded state a safe operation.

Accordingly, it is an object of the present invention to provide an apparatus which may be used to lift and transport heavy objects.

It is a further object of the present invention to provide an apparatus which provides for one man operation.

It is further object of the present invention to provide an apparatus which acts in combination with a ladder or similar support structure to lift a heavy object from ground level to the rooftop of a multi-story building without placing undue stresses on the support structure.

It is a further object of the present invention to provide an apparatus which may be used to transport an object across a roof top to any desired position.

In accordance with the above objects of the present invention, it is a feature of the invention to provide a light weight collapsible framework.

It is another feature of the present invention to provide lockable wheels on the frame.

It is a further feature of the present invention to provide a means for attaching the apparatus to a ladder or similar structure. It is a further feature of the present invention to provide a lifting means on the framework of the invention. It is a further feature of the present invention to provide the operator a safe operating and vantage point above the object being lifted.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and, wherein.

DETAILED DESCRIPTION OF THE INVENTION

Figure 8:
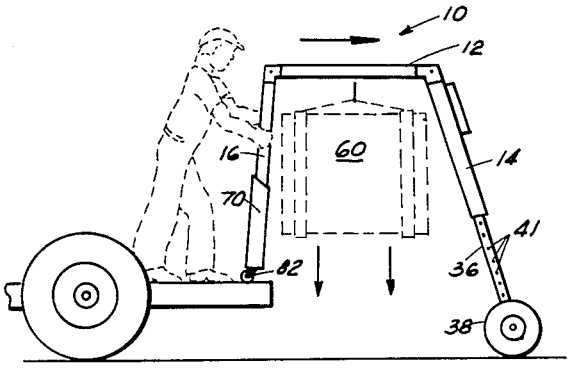
FIG. 8 illustrates the invention removing a load from a truck.

Referring now to the drawings, it can be seen that the apparatus is generally referred to by the numeral 10. Apparatus 10 is generally comprised of horizontal frame support 12, truck leg portion 14, handle leg portion 16, means 18 for folding and latching apparatus 10, means 20 for lifting a load and means 22 for placing handle leg 16 in communication with the ground for support while apparatus 10 is used to lift a load to an elevated site.

Figure 3:
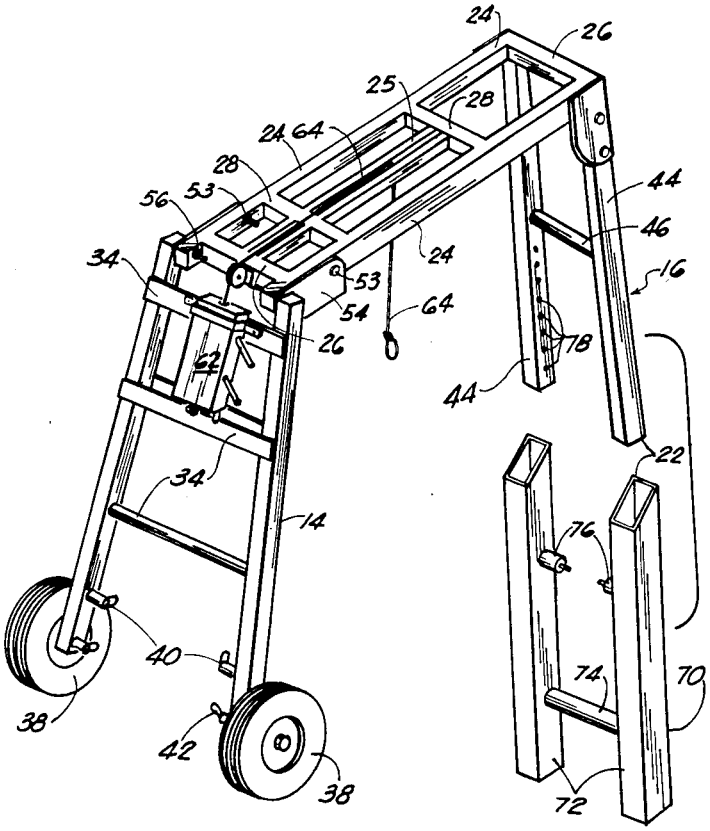
FIG. 3 is an isometric view of the invention and illustrates the method by which it fits into a separate support bracket.

As best seen in FIG. 3, horizontal frame support 12 is comprised of parallel outside rails 24, parallel inside support rails 25, transverse supports 26 attached at each end of parallel side rails 24, 25 and interior parallel load transferring supports 28 attached to side rails 24, 25. Transverse supports 26 and 28 are rigidly connected to parallel side rails 24, 25 to prevent bending or twisting of horizontal frame support 12 during use of apparatus 10 for lifting and transporting loads.

Figure 2:
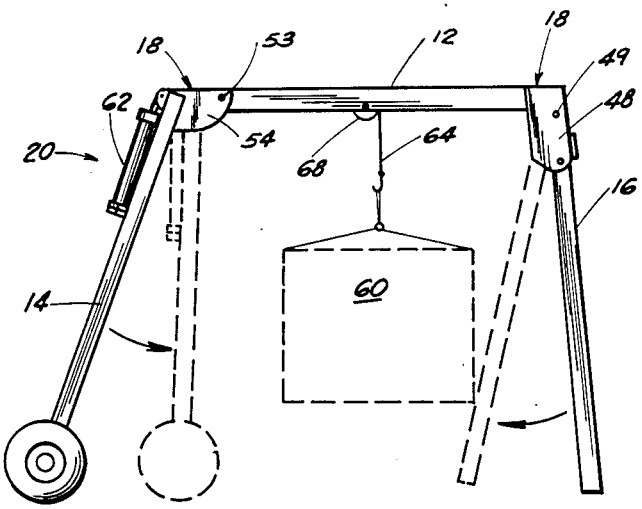
FIG. 2 illustrates the invention in side view in a partially folded state in phantom view.
Figure 10:
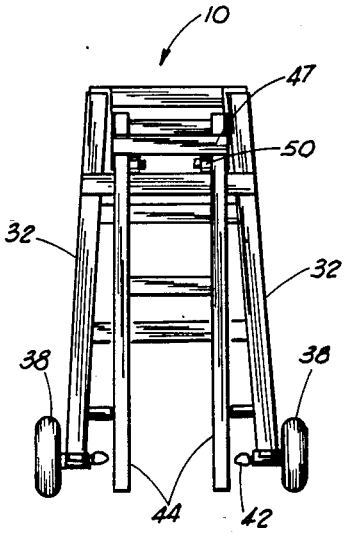
FIG. 10 is an end view of the device.
Figure 9:
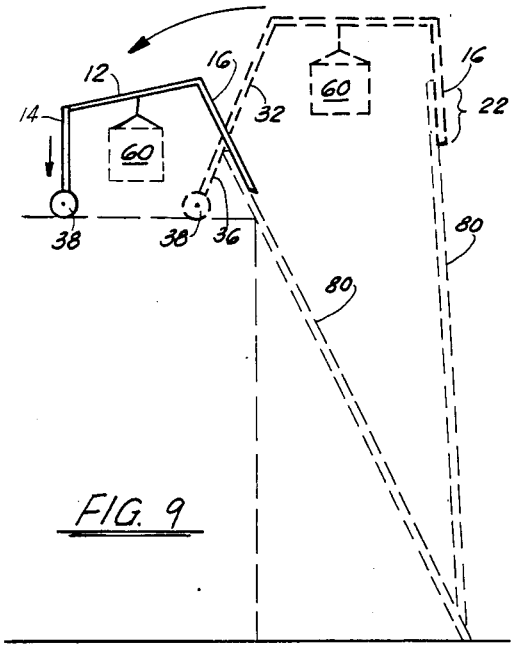
FIG. 9 illustrates the pivotal action of the ladder as the load is moved from lifting position to loading position.
Figure 7:
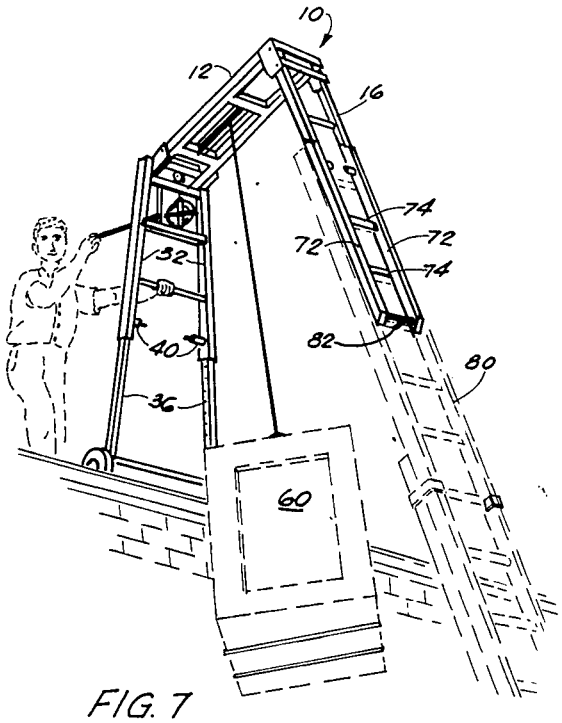
FIG. 7 illustrates the invention being used to lift a load to a roof top.

As best seen in FIG. 2, a first downwardly extending leg of truck leg portion 14 is pivotally connected at one end of horizontal frame support 12 at hinge pin 53. Truck leg portion 14 is comprised of a pair of spaced elongated side legs 32 which are rigidly connected to each other by transverse supports 34. Side legs 32 are not parallel but extend outwardly from the pivot plates 54, which are pivotally connected to horizontal frame support 12 at pin 53 so that the width separating the ends of each leg 32 of wider than the connection at horozontal support 12. This provides a wide stance at truck leg portion 14, prevents tipping of apparatus 10 during use while supporting or transporting a load and allows telescoping members 36, best seen in FIG. 7, to frictionally absorb loads while telescopically acting. Side legs 32 are hollow and house means for adjusting the height of apparatus 10 during use as seen in FIGS. 8 and 9. Telescoping legs 36 are housed within side legs 32 and have wheels 38 rotatably mounted at the ends thereof. Telescoping legs 36 may be locked in a desired extended or retracted position, as illustrated in FIGS. 7 and 8, by the use of latches 40. In the preferred embodiment, latches 40 are positioned approximately five inches from the bottom of each of side legs 32 to prevent over extension of legs 36 and have spring loaded latch pins which extend into the interior bore of legs 32. Telescoping legs 36 are slidable within side legs 32 and are provided with apertures 41, seen in FIG. 8, which are sized to receive the pins of latches 40 to lock telescoping legs 36 in any desired position. In the preferred embodiment, latches 40 are of a type which allow one-handed operation of the latches for extension and retraction of telescoping legs 36 while supporting apparatus 10. Latches 40 may be spring loaded to allow the pins to "find" the apertures 41 of legs 36. However, they should also lock in the outward position for overall ease of operation of apparatus 10. As best seen in FIG. 3, cam locks 42 are provided on the axles of wheels 38 so that wheels 38 may be locked into position and prevent unwanted movement of apparatus 10 during lifting or lowering of a load. Cam locks 42 are designed in the preferred embodiment so as to be easily operable by foot pressure from the operator of apparatus 10. In the preferred embodiment, truck leg portion 14 folds out beyond a 90° angle at approximately 25° past vertical to horizontal frame support 12, as illustrated in FIG. 2, to provide ease of operation during the use of apparatus 10 as a hand truck and as best seen in FIGS. 2 and 10, to provide greater clearance during the lifting of loads.

Pivotally attached at the opposite end of horizontal frame support 12 is a second downwardly extending leg or handle leg portion 16. Handle leg portion 16 is comprised of a pair of spaced parallel elongated side rails 44 which are rigidly connected to each other by transverse members 46. In the preferred embodiment, one of the two transverse support members 46 rigidly connect side rails 44 at a point substantially near the pivotal connection of handle leg portion 16 with horizontal frame support 12 and substantially at the center of handle leg portion 16. This support member may also serve as a handle when lifting apparatus 10 into the dollying position (seen in FIG. 4). In the preferred embodiment, handle leg 16 folds out from horizontal frame support 12 slightly beyond the 90° position to horizontal frame support 12, approximately 4° past vertical, to induce proper ladder position in lifting position and further add stability to apparatus 10.

When in their unfolded positions, truck leg portion 14 and handle leg portion 16 form an inverted generally U-shaped frame, as best seen in FIG. 2. In the preferred embodiment, truck leg portion 14 and handle leg portion 16 fold inwardly toward horizontal frame support 12 to form a compact unit, illustrated in FIGS. 2 and 5, which allows apparatus 10 to be easily stored on a bracket on the side of a work vehicle or transported by the operator up a ladder on the operator's back by use of straps attached to apparatus 10.

Figure 1:
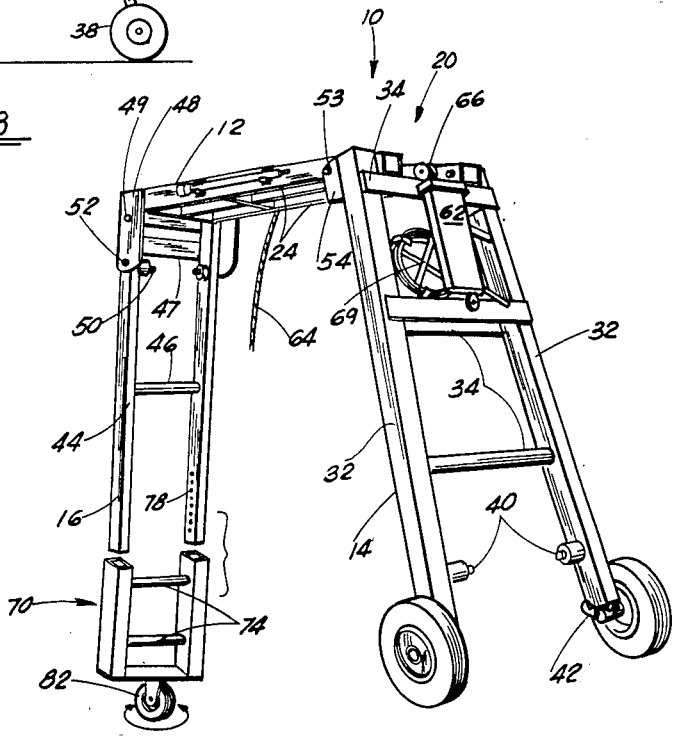
FIG. 1 illustrates the invention in its unfolded operative position.
Figure 4:
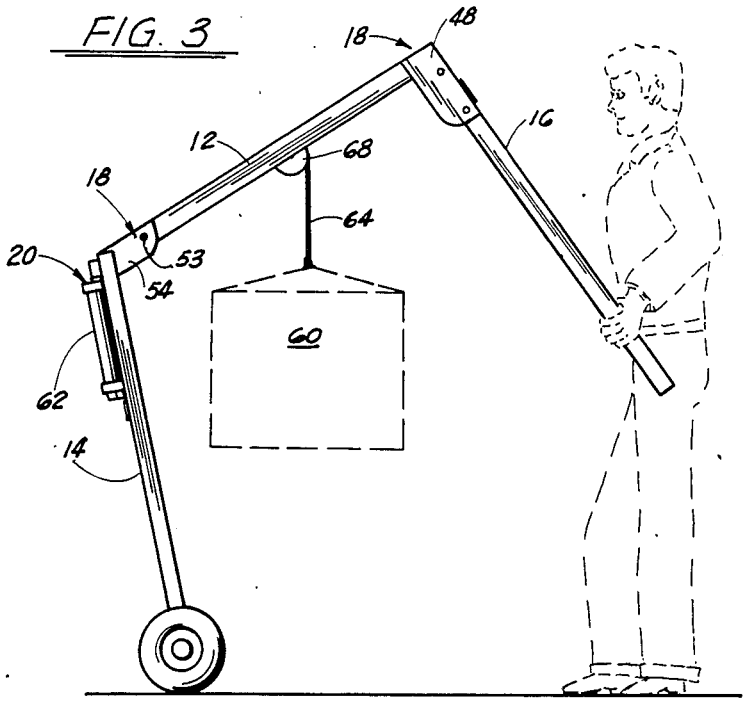
FIG. 4 illustrates in side view the use of the invention as a hand truck to transport a load.
Figure 5:
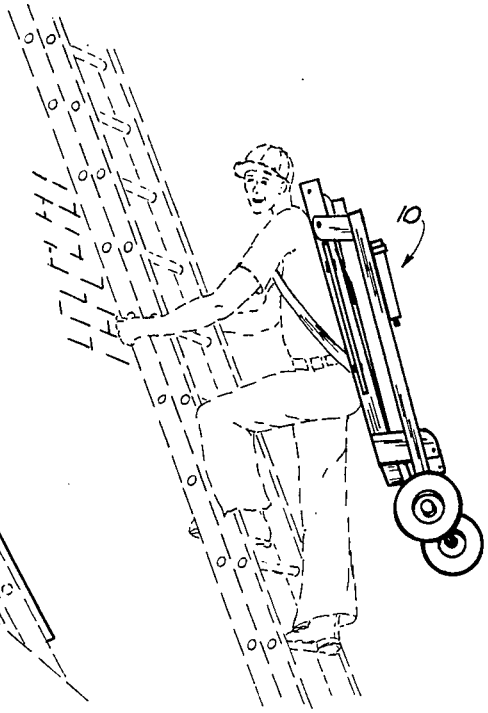
FIG. 5 illustrates the method by which the invention may be transported to a roof top by the user.

In the preferred embodiment, means 18 for folding apparatus 10 into its inoperative position as illustrated in FIG. 5 or unfolding and latching apparatus 10 into its operative position illustrated in FIGS. 1, 4, 6, 7, 8 and 9 are provided on horizontal frame support 12 and truck leg portion 14 and handle leg portion 16. As seen in FIGS. 1 and 2, attached to the exterior portion at one end of horizontal frame support 12 are downwardly extending flanges 48. Flanges 48 are provided with hinged pins 49 for pivotal connection to parallel side legs 44 of handle leg portion 16 to allow folding and unfolding movement of handle leg 16 in relation to horizontal frame support 12. A means of locking handle leg 16 in its unfolded position is provided in snap latch 50 provided on the interior of each leg portion 44 of handle leg portion 16. In the preferred embodiment, latches 50 are spring loaded and operable by one hand, similar to latches 40, and have pins which are received by apertures 52 in flanges 48 to lock handle leg portion 16 in its unfolded operative position. Transverse member 47, best seen in FIGS. 1 and 10, is rigidly attached to flanges 48 and serves as a stop to prevent handle leg 16 from pivoting beyond its preferred position and to provide support to flanges 48 and handle leg 16. At the opposite end of frame portion 12, truck leg portion 14 is pivotally attached to horizontal frame support 12 in much the same manner as handle leg portion 16, that is by hinge pins 53 extending through parallel side members 24 into flanges 54 of truck leg portion 14. Truck leg portion 14 is provided with flanges 54 on each leg which are rigidly attached thereto and pivot with truck leg portion 14 around the exterior of parallel side rails 24. Truck leg portion 14 is locked into its unfolded operative position by snap latches 56, seen in FIG. 3, which are positioned on the interior portion of parallel side rails 24 adjacent the pivotal connection of truck leg portion 14 with horizontal frame support 12. Latches 56 are spring loaded in a manner similar to latches 40 and 50 and have pins which extend through parallel side rails 24 and are received by recesses not shown in flanges 54 to lock truck leg portion 14 in its unfolded and operative position. Latches 50 (in FIG. 1) and 56 (in FIG. 5) act in cooperation with the apertures provided in flanges 48 and 54 to positively lock apparatus 10 in its operative position to prevent unwanted folding of apparatus 10 during the lifting, lowering or transportation of a load 60 with apparatus 10.

A means 20 for lowering, lifting and supporting a load during use of apparatus 10 is provided on horizontal frame support 12 and truck leg portion 14. Means 20 is preferably comprised of winch 62, cable or rope 64, fixed pulley 66 and adjustable pulley 68 all as best seen in FIG. 4. Winch 62 is attached to truck leg portion 14 for ease of operation during use and to provide a flat surface on frame support 12 for storage and backpacking and may be any suitable type, such as a conventional ratchet winch or electric winch. A cable, chain or rope 64 is used in conjunction with winch 62 to provide lifting through fixed pulley 66 and adjustable pulley 68 and is matched in strength characteristics to apparatus 10. Cable 64 is engaged in winch 62 and guided by fixed pulley 66 which is rotatably mounted near the end of inside support rails 25 of frame support 12 (in FIG. 3) adjacent truck leg portion 14 and aligned with the discharge of winch 62. Cable 64 is further guided by adjustable pulley 68. Pulley 68 is rotatably mounted between the inside support rails 25 in horizontal frame support 12. Inside support rails 25 are provided with a plurality of apertures for receiving the rotational mounting pin of pulley 68 so that pulley 68 may be selectively positioned to vary the positioning of load 60 upon apparatus 10. The position of pulley 68 is adjustable between transverse supports 26 to allow for various load weight distribution and/or to help achieve better load clearance when lifting to rooftop level. Cable 64, after engagement with winch 62 is guided over first pulley 66 and over second pulley 68 and then downwardly between truck leg portion 14 and handle leg portion 16 for attachment to load 60. In the preferred embodiment a cage 69 (in FIG. 1) is rotatably mounted on truck leg portion 14 opposite winch 62 for receiving or feeding out cable 64 as it is used or returned and maintaining cable 64 in an untangled and ready to use coil.

Figure 6:
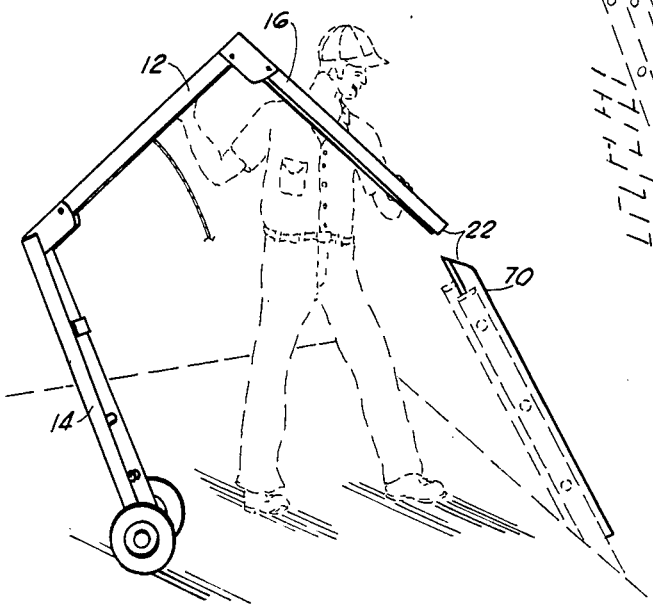
FIG. 6 illustrates the user attaching the invention to a support bracket connected to a ladder.

As seen in FIGS. 3, 6 and 7, a means 22 is provided for communicating handle leg portion 16 with the ground to support apparatus 10 while apparatus 10 is being used to lift or lower load from a rooftop. Means 22 comprises generally a bracket 70 and a means for connecting apparatus 10 to bracket 70. Bracket 70 is comprised of a pair of hollow parallel side rails 72 which are rigidly connected to each other by a pair of transverse support 74. In the preferred embodiment, transverse supports 74 are positioned near the lower end of bracket 70 and in such position as to be adjacent with the other ladder rungs when attached to a ladder. Positioned on the interior portion of side rails 72 (in FIG. 3) so as to promote proper minimum insertion of handle leg 16 are snap latches 76 similar to latches 50. Latches 76 are spring loaded in the preferred embodiment and have pins which protrude into the hollow portion of side rails 72. Parallel side legs 44 of handle leg portion 16 are sized so that they may be received within the hollow portion of parallel side rails 72. Side legs 44 are provided with a plurality of diametrically opposed apertures 78 on the interior side which are sized to receive the pins in snap latches 76, thus locking side legs 44 and apparatus 10 onto bracket 70. Bracket 70, seen best in FIG. 5, 6 and 7, may be attached to a conventional industrial ladder 80 by the use of U-bolts not shown by a rung to rung connection or side rail to side rail connection. Once bracket 70 has been attached to a conventional adder 80 and handle leg portion 16 has been locked into ladder bracket 70, handle leg portion 16 is in supporting communication with the ground via the ladder while truck leg portion 14 is supported by the rooftop. Apparatus 10 is then fully supported on both ends and may be used to lift a load to a rooftop or lower a load from a rooftop to ground level without putting undue stresses on the ladder members. In the preferred embodiment, bracket 70 is sized with the spacing of side rails 72 and transverse supports 74 to match the size of conventional industrial use ladders with a minimum rating of 250 pounds and 12½ inch spacing between side pieces so that bracket 70 may be kept attached to ladder 80 and not interfere with the normal use of ladder 80 when apparatus 10 is not used in combination with ladder 80 for lifting and lowering loads. This also provides a lifting capacity of approximately 500 pounds because the weight is distributed between the roof and ladder, and not supported only by the ladder as in the prior art references.

As illustrated in FIGS. 1 and 8, bracket 70 is provided with a wheel 82 attached to lower transverse support 74 and substantially near its center. Wheel 82 is pivotally mounted onto transverse support 74 so that bracket 70 may be attached to apparatus 10 as described above to also allow use of apparatus 10 as a three-wheel dolly. The pivotal mounting of wheel 82 also allows bracket 70 to be attached to ladder 80 without interfering with the normal use of ladder 80 by allowing pivoting of wheel 82 so that its axis of rotation is substantially parallel to transverse supports 74 and the rungs of ladder 80.

As illustrated in the preferred embodiment, apparatus 10 is constructed of square aluminum tubing but may be constructed utilizing any suitable material providing the necessary strength, rigidity and weight limitations for safe and easy use by the operator.

In operation, apparatus 10 utilizes a minimum of space by the ability to be stored in its folded inoperative state with truck leg portion 14 and handle leg portion 16 being folded inwardly adjacent horizontal frame support 12, as illustrated in FIGS. 2 and 5. When the operator desires to use apparatus 10 to transport or lift a load, apparatus 10 is easily unfolded into its operative position by pivotal connections at each end of horizontal frame support 12 to truck leg portion 14 and handle leg portion 16. Leg portions 14 and 16 are readily locked into their operative positions through the cooperation of flanges 48 and 54, latches 50 (in FIG. 1) and 56 (in FIG. 3) respectively and apertures 52 and recesses not shown in flange 54 respectively which receive the pins of latches 50 and 56. Apparatus 10 may then be used to remove a load 60 from a vehicle as illustrated in FIG. 8 and transport load 60 to the point of installation as illustrated in FIG. 4. Apparatus 10 as best seen in FIG. 8, is used to remove a load from a vehicle by locking telescoping legs 36 provided on truck leg portion 14 in an extended position. Handle leg 16 is then positioned in the vehicle with horizontal frame support 12 being above load 60. Cable 64 is then attached to load 60 and winch 62 is used to lift load 60. The operator then pulls or pushes apparatus 10 and until load 60 is over the ground, thus enabling him to lower load 60 to the ground. Apparatus 10 may then be used as a hand truck, as illustrated in FIG. 4 or a three-wheel dolly, to transport load 60 to the side of a building. Apparatus 10 is then folded into its inoperative position and transported up a ladder 80 to the rooftop on the back of the user as illustrated in FIG. 5. Apparatus 10 is then unfolded into its operative position and attached to bracket 70 as illustrated in FIG. 6. Apparatus 10 is then used to position the ladder or similar structure away from the side of the building after first attaching cable 64 to load 60 at ground level by extending telescopic members 36 for continuous distribution of weight between roof and ladder. Winch 62 is then used to lift load 60 up to the rooftop level. Once load 60 is raised to the rooftop level, telescoping legs 36 are then retracted to cause a weight shift toward the building and allow easy movement of load 60 over the rooftop as illustrated in FIG. 9 without putting undue stresses on the ladder member because of the continuous contact of wheels 38 with the rooftop. The load 60 is then lowered to the rooftop, legs 44 are removed from bracket 70 and apparatus 10 may then be used again as a hand truck to transport load 60 to the installation to on the rooftop. Lockable wheels 38 may be used to prevent unwanted movement of apparatus 10 during lifting of load 60 to the rooftop but the balancing of the load by adjusting of telescoping legs 36 provides the main method of preventing unwanted movement during lifting of the load 60. The positioning of truck leg portion 14 and handle leg portion 16 beyond 90° in relation to frame portion 12 prevents ladder 80, apparatus 10 and load 60 from swaying away from the building side during lifting of load 60 by maintaining ladder 80 at an angle toward the building.

As seen in FIG. 9, when in the lifting position, apparatus 10 may safely be positioned with the juncture of truck leg portion 14 and frame support 12 in alignment with or beyond the corner of the building to provide sufficent working area for lifting of load 60.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A portable apparatus for lifting, transporting and distributing a load, comprising:

a. a horizontal frame support having parallel side rails connected by transverse supporting members;

b. a first ladder shaped leg, having a pair of side rails connected by transverse supports and extending transversely away from said side rails of said horizontal support, thereby forming a base on said first leg being wider than said horizontal frame support, said first leg being, pivotally connected to a first end of said horizontal frame support and moveable between a first folded inoperative position and a second unfolded operative position, said first leg extending downwardly from said horizontal frame support when in said second operative position, said first leg including first and second telescopically mating members, whereby the length of said first leg is selectively adjustable;

c. a second ladder shaped leg, having a pair of spaced parallel side members connected by transverse supports, and pivotally connected to the other end of said horizontal frame support and moveable between a first folded inoperative position and a second unfolded operative position, said second leg extending downwardly from and substantially perpendicular to said horizontal frame member when in said second operative position;

d. means operatively connected to said first leg and said horizontal support for lifting and lowering a load, including a first pulley fixedly mounted on said horizontal frame member and a second pulley mounted on said horizontal frame member and moveable longitudinally therealong;

e. means connected to said first leg for transporting said apparatus and said load;

f. means for communication of said second leg with the ground, forming a support for lifting a load, said communication means comprising a generally ladder shaped bracket engageable with a ladder-like structure and said second leg, and being selectively adjustable in length whereby said load is distributed over both said first and second leg members and the ground when said first leg rests on a surface when is elevated with respect to the ground; and g. means for locking said first and second legs in said second unfolded operative position, further comprising:

a. a pair of spring loaded latches extending through said side rails of said horizontal support;

b. said first leg having apertures for receiving said latches;

c. a pair of spring loaded latches extending through said side members of said second leg; and d. a pair of flanges connected to said side rails of said horizontal support having apertures therethrough for receiving said latches said portable apparatus in said first folded inoperative position is transportable on the back of a user.

2. The apparatus of claim 1, wherein said means for transporting said apparatus and said load comprises lockable wheels connected to said first leg.

3. The apparatus of claim 1, wherein said first leg further comprises:

a. side rails having a longitudinal bore therethrough;

b. a telescoping leg member slidably engaged within each of said bores and having vertically spaced and diametrically opposed apertures therethrough;

c. snap latches connected to said side rails of said first leg extending into said bore for releasably mating with said apertures in said telescoping legs to lock said telescoping legs in an extended position; and d. a wheel rotatably mounted on each of said telescoping leg members.

4. The apparatus of claim 1, wherein said ladder shaped bracket for communication of said second leg with the ground comprises:

a. a bracket attachable to a ladder and having:

i. a pair of spaced parallel side rails having longitudinal bores therethrough for receiving said parallel side members of said second leg;

ii. at least two transverse members connecting said said rails; and iii. snap latches associated with said side rails extending into said longitudinal bores; and b. said parallel side members of said second leg having a plurality of longitudinally spaced apertures for receiving said latches and locking said frame in engagement with said bracket.

5. The apparatus of claim 1, wherein said apparatus is constructed of lightweight metal.

6. The apparatus of claim 1, wherein said means for lifting and lowering a load further comprises:

a. a winch connected to said first leg;

b. said first pulley being mounted on said horizontal frame member near said first leg member; and c. a cable in driven engagement with said winch and said pulleys for connection to a load to be lifted.

* * * * *